US009987516B1

(12) United States Patent
Chen

(10) Patent No.: US 9,987,516 B1
(45) Date of Patent: Jun. 5, 2018

(54) CURVED TREADMILL

(71) Applicant: YING LIANG HEALTH TECH. CO., LTD., Taoyuan (TW)

(72) Inventor: Chih-Liang Chen, Taoyuan (TW)

(73) Assignee: YING LIANG HEALTH TECH. CO., LTD., Taoyuan (TW)

( * ) Notice: Subject to any disclaimer, the term of this patent is extended or adjusted under 35 U.S.C. 154(b) by 26 days.

(21) Appl. No.: 15/357,432

(22) Filed: Nov. 21, 2016

(51) Int. Cl.
*A63B 21/00* (2006.01)
*A63B 22/02* (2006.01)
*A63B 21/22* (2006.01)

(52) U.S. Cl.
CPC ..... *A63B 22/0285* (2013.01); *A63B 21/225* (2013.01); *A63B 21/4034* (2015.10); *A63B 21/4035* (2015.10)

(58) Field of Classification Search
None
See application file for complete search history.

(56) References Cited

U.S. PATENT DOCUMENTS 8,343,016 B1 * 1/2013 Astilean ..... A63B 21/156 482/54
8,986,169 B2 * 3/2015 Bayerlein ..... A63B 21/0053 482/54
9,005,085 B2 * 4/2015 Astilean ..... A63B 22/02 482/54
2015/0352400 A1 12/2015 Bayerlein et al.
2016/0144224 A1 5/2016 Dalebout et al.
2016/0367851 A1 * 12/2016 Astilean ..... F03G 5/00
2018/0001134 A1 * 1/2018 Bayerlein ..... A63B 22/025

FOREIGN PATENT DOCUMENTS

CN 203315649 U 12/2013
EP 3031499 A1 6/2016

OTHER PUBLICATIONS

United Kingdom Patent Office, Search Report.

* cited by examiner

*Primary Examiner* — Stephen R Crow
(74) *Attorney, Agent, or Firm* — Rabin & Berdo, P.C.

(57) ABSTRACT

A curved treadmill has a frame, a handrail assembly, and a belt assembly. The frame has a support frame, two arced guide tracks and multiple guide wheels. The two arced guide tracks are downwardly concave, and the multiple guide wheels are disposed at a front end and a rear end of the support frame. The belt assembly is mounted around the frame and has at least one connection belt mounted around the guide wheels and multiple pedals fixed with the at least one connection belt. The pedals are adjacent and connected to each other, the pedals are covered on an outer side face of each of the at least one connection belts, and each pedal has a plate fixed to the at least one connection belt and multiple bearings mounted on two ends of the plate and selectively abutting against the two arced guide tracks.

18 Claims, 7 Drawing Sheets

CURVED TREADMILL

BACKGROUND OF THE INVENTION

1. Field of the Invention

The present invention relates to fitness equipment, and more particularly to a curved treadmill that can be operated in an ergonomic way.

2. Description of Related Art

A conventional treadmill has a deck, a belt, and a power device. The belt is mounted around the deck, and the power device is connected to the belt. The belt is driven by the power device to move around the deck in circulations. In order to withstand the momentum provided by a running user, the deck is strong in rigidity and not easily deformed. Thus, the deck does not have a buffering effect, and this may accelerate wearing off of the user's knee joint and ankle after a long-term of use. Some treadmills are equipped with a suspension similar to the car suspension structure to provide a buffer, but this will increase the cost for manufacturing the treadmills, making the treadmills difficult to afford for most consumers. Or some treadmills are equipped with thick belts or installed with pads on the platform, etc. The conventional way of providing a buffering function to a treadmill may lower the cost, but the buffering effect is limited.

To overcome the shortcomings of the conventional treadmill, the present invention provides a curved treadmill to mitigate or obviate the aforementioned problems.

SUMMARY OF THE INVENTION

The main objective of the present invention is to provide a curved treadmill which may be operated in an ergonomic way.

The curved treadmill has a frame, a handrail assembly, and a belt assembly. The frame has a support frame, two arced guide tracks and multiple guide wheels, the two arced guide tracks are downwardly concave, and multiple guide wheels are disposed at a front end and a rear end of the support frame. The belt assembly is mounted around the frame and has at least one connection belt mounted around the guide wheels and multiple pedals fixed with the at least one connection belt. The pedals are adjacent and connected to each other, the pedals are covered on an outer side face of each of the at least one connection belt, and each pedal has a plate fixed to the at least one connection belt and multiple bearings mounted on two ends of the plate and selectively abutting against the two arced guide tracks.

Other objects, advantages, and novel features of the invention will become more apparent from the following detailed description when taken in conjunction with the accompanying drawings.

DETAILED DESCRIPTION OF PREFERRED EMBODIMENT

Figure 1:
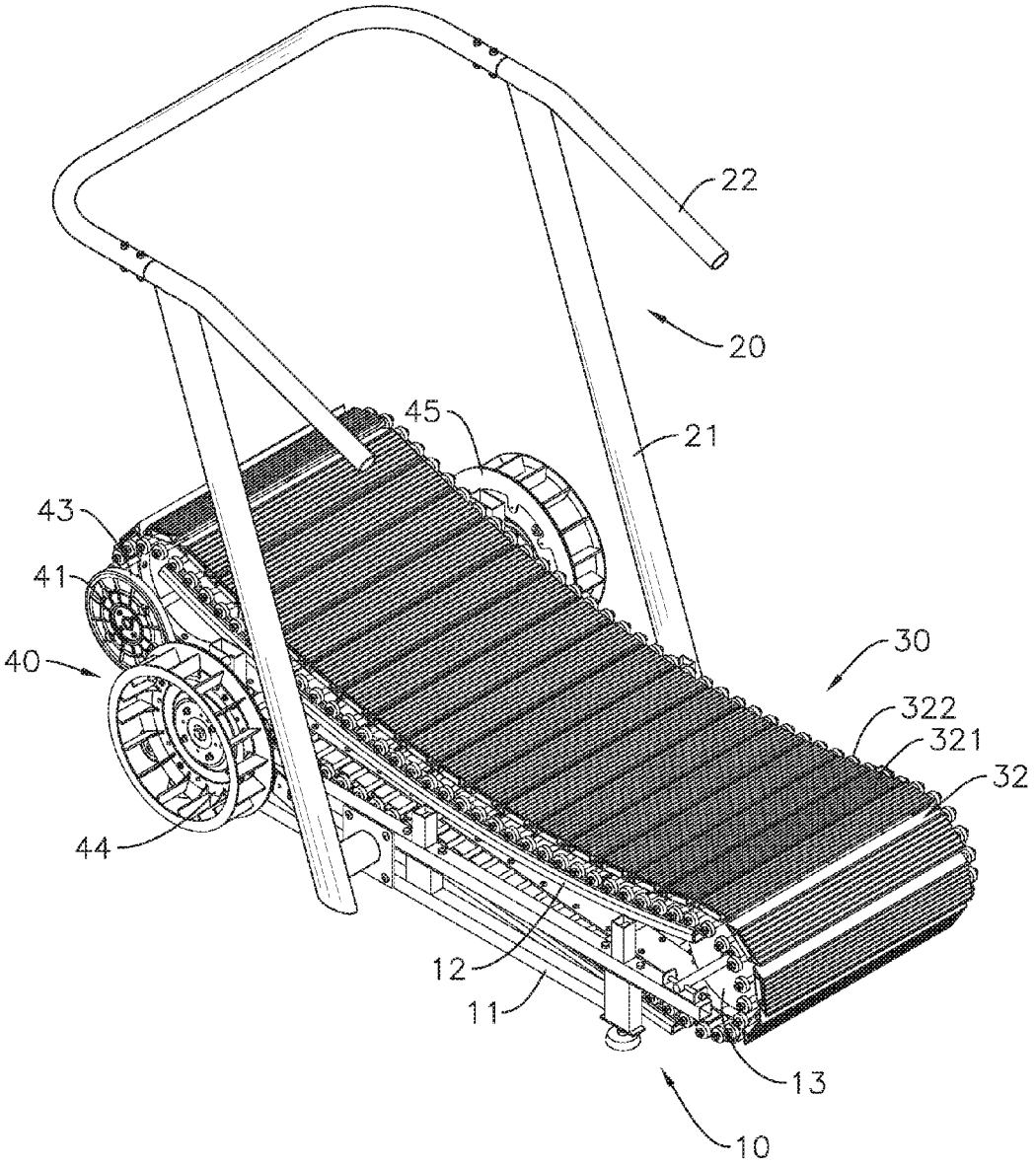
FIG. 1 is a perspective view of a curved treadmill in accordance with the present invention.
Figure 2:
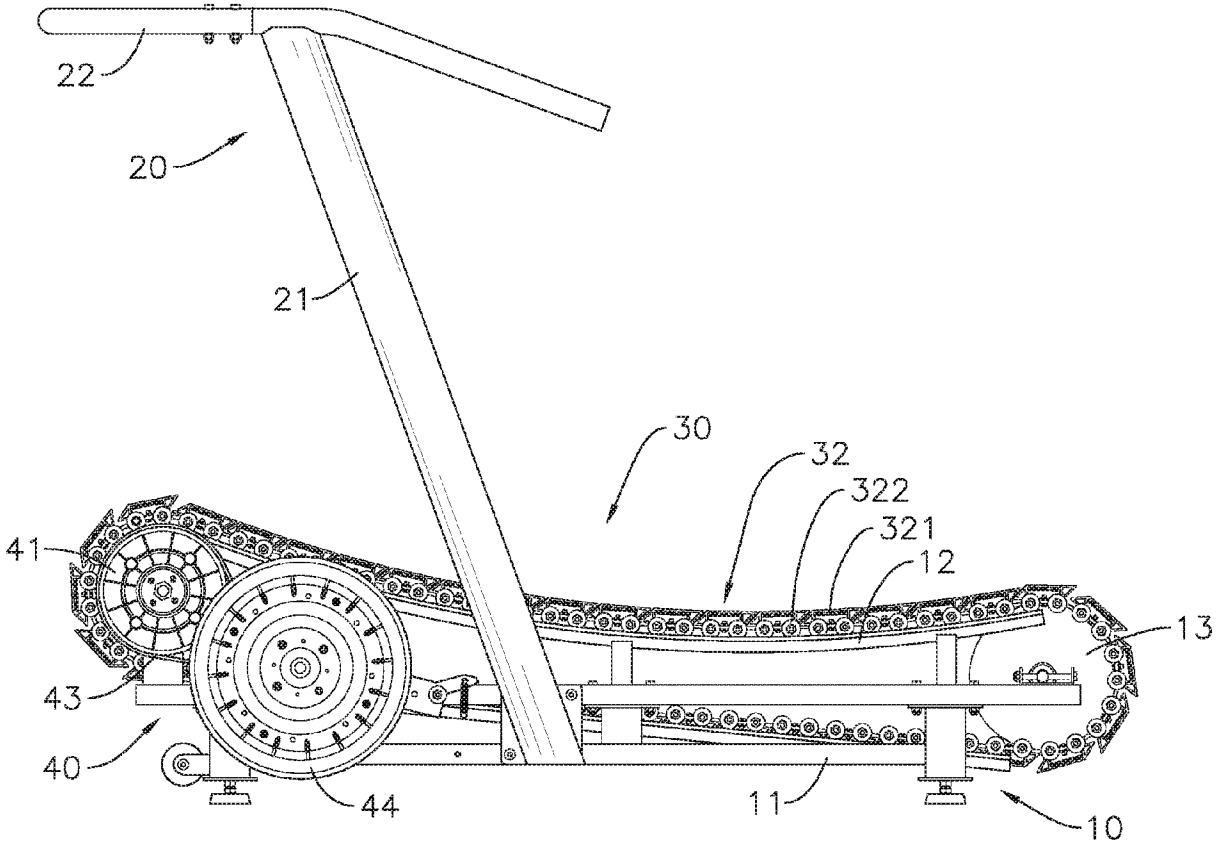
FIG. 2 is a side view of the curved treadmill in FIG. 1.
Figure 3:
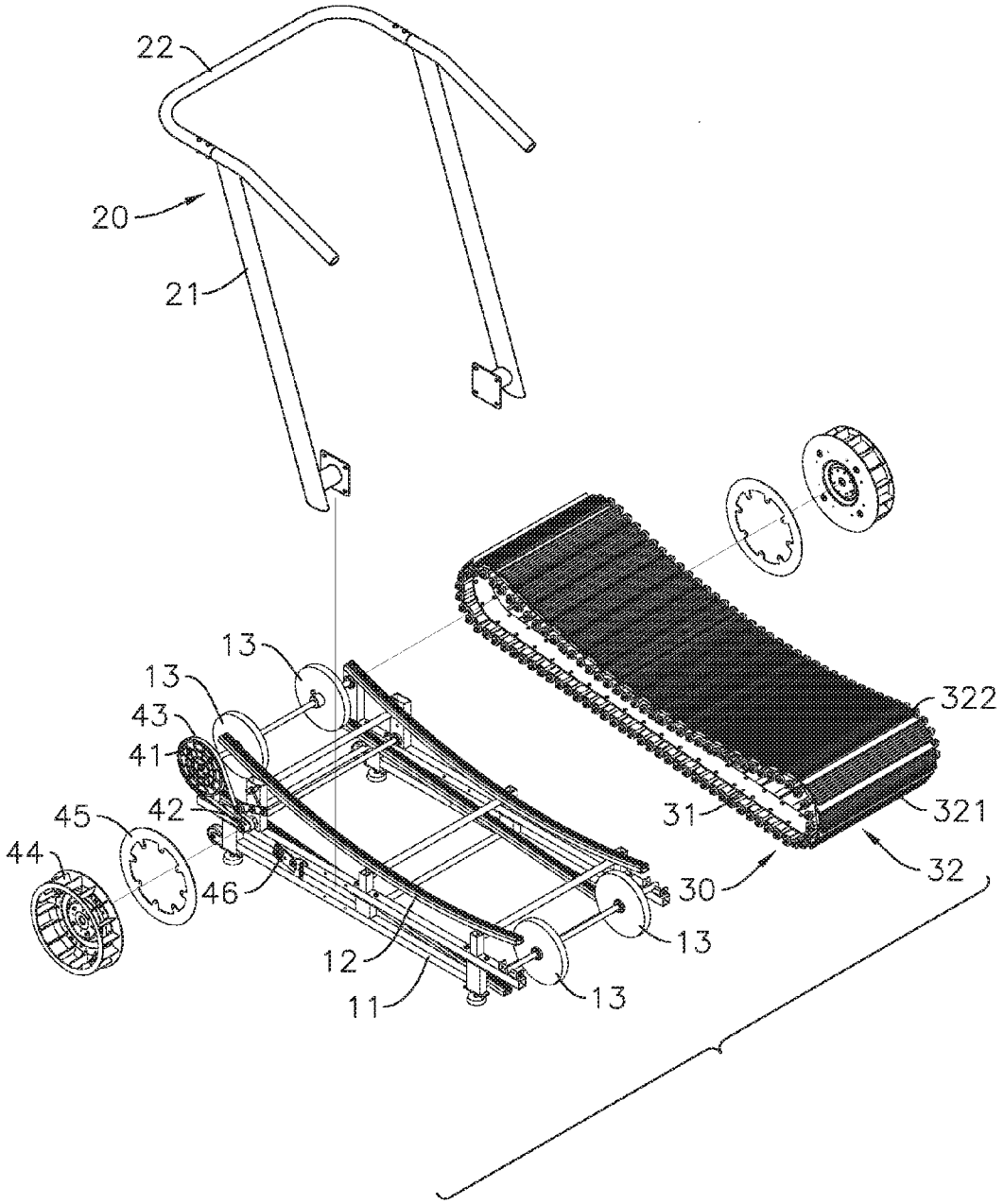
FIG. 3 is an exploded perspective view of the curved treadmill in FIG. 1.

With reference to FIGS. 1 to 3, a curved treadmill in accordance with the present invention comprises a frame 10, a handrail assembly 20, a belt assembly 30, and two flywheel assemblies 40.

The frame 10 has a support frame 11, two arced guide tracks 12, and multiple guide wheels 13. The support frame 11 has a front end and a rear end. The two arced guide tracks 12 are respectively located on two sides of the support frame 11 and are parallel to each other. The two arced guide tracks 12 are downwardly concave. The multiple guide wheels 13 are disposed at the front end and the rear end of the support frame 11. In the preferred embodiment, four guide wheels 13 are implemented. Two of the four guide wheels 13 are disposed at the front end of the support frame 11, and protrude from the front end of the support frame 11. The other two guide wheels 13 are disposed at the rear end of the support frame 11, and protrude from the rear end of the support frame 11. Besides, the two guide wheels 13 at the front end of the support frame 11 are connected with each other by a shaft, and this enables the two guide wheels 13 at the front end of the support frame 11 to rotate synchronously. The two guide wheels 13 at the rear end of the support frame 11 are connected with each other by another shaft, and this enables the two guide wheels 13 at the rear end of the support frame 11 to rotate synchronously. Furthermore, the two guide wheels 13 on a right side are defined as right group wheels. The other two guide wheels on a left side are defined as left group wheels.

The handrail assembly 20 is mounted on the two sides of the support frame 11 of the frame 10, and has two poles 21 and a handrail 22. Each one of the poles 21 has a top end and a bottom end. The bottom ends of the two poles 21 are fixed respectively with the two sides of the support frame 11. The handrail 22 is fixed with the top ends of the two poles 21.

Figure 4:
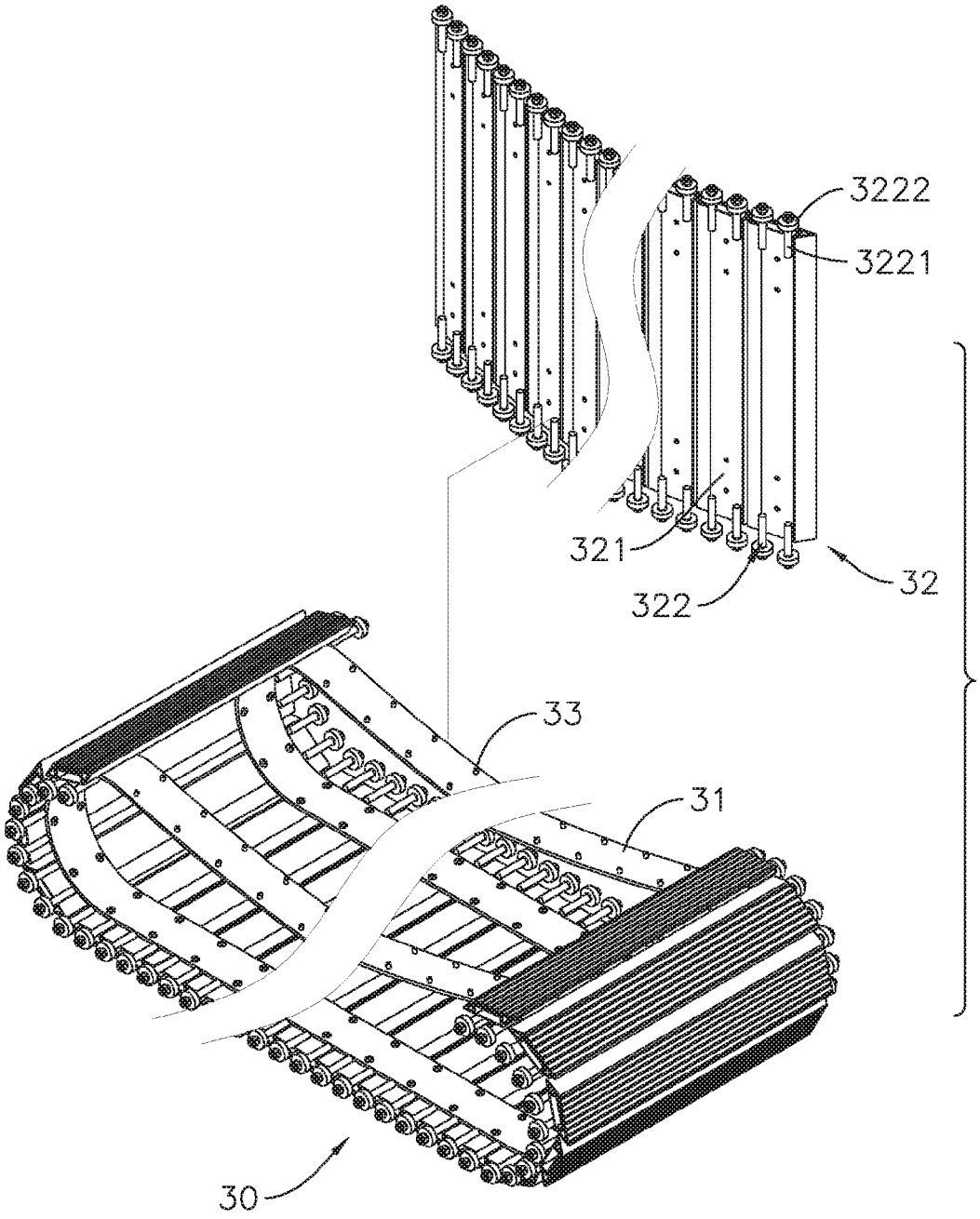
FIG. 4 is an enlarged exploded perspective view of a belt assembly of the curved treadmill in FIG. 1.
Figure 5:
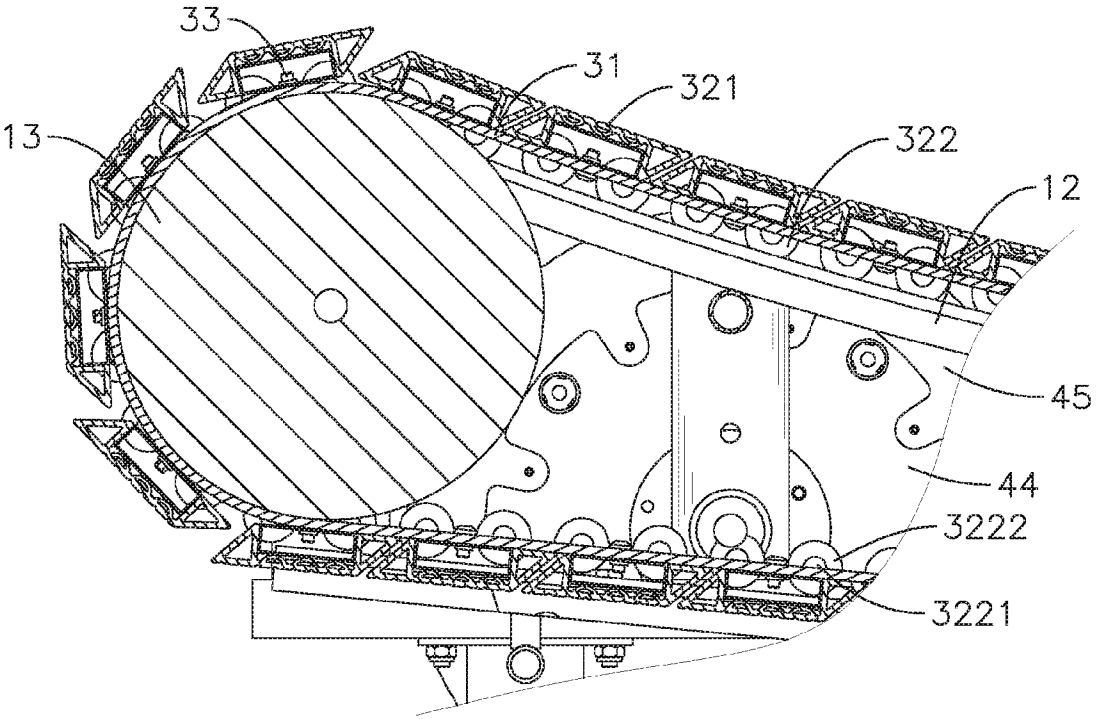
FIG. 5 is an enlarged partial side view in partial section of the curved treadmill in FIG. 1.
Figure 6:
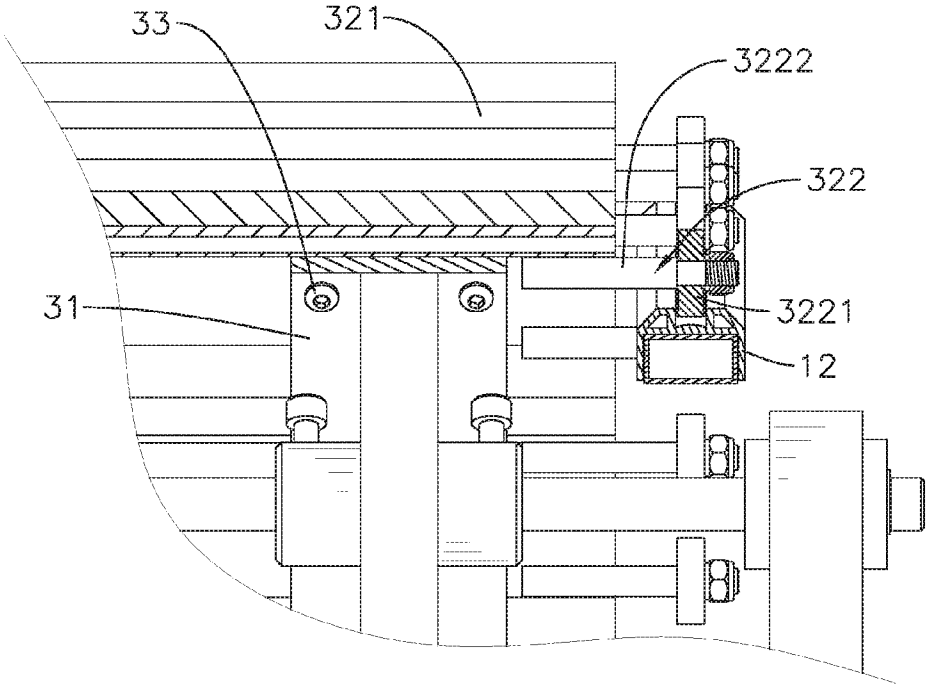
FIG. 6 is another enlarged partial side view in partial section of the curved treadmill in FIG. 1.

With reference to FIG. 4 to FIG. 6, the belt assembly 30 is mounted around the frame 10 and has at least one connection belt 31 and multiple pedals 32.

The at least one connection belt 31 surrounds the frame 10 and is mounted around the guide wheels 13. In the preferred embodiment, two connection belts 31 are implemented, and one of the two connection belts 31 is mounted around the right group wheels. The other connection belt 31 is mounted around the left group wheels. Alternatively, the number of the connection belt 31 may be one. The connection belt 31 extends from the left side of the support frame 11 to the right side of the support frame 11, such that the connection belt 31 is mounted around the four guide wheels.

With further reference o FIG. 4, the pedals 32 are fixed with the two connection belts 31, are adjacent and connected to each other, and cover outer side faces of the connection belts 31. Each pedal 32 has a plate 321 and multiple bearings 322. The plate 321 is fixed on the connection belts 31. In the embodiment, the connection belt 31 has multiple through holes, and the plate 321 has multiple screw holes formed through a bottom of the plate 321. Therefore, screws 33 are mounted through the through holes of the connection belt 31 and are fastened in the screw holes of the plate 321 to fix the plate 321 on the connection belt 31. The bearings 322 are mounted on two ends of the plate 321 and selectively abut against the two arced guide tracks 12. In this embodiment, each one of the pedals 32 has four bearings 322, and two of the four bearings 322 are respectively provided at the two ends of the plate 321 so that the plate 321 does not turn over. Each bearing 322 has a connecting shaft 3221 and a collar 3222. One end of connecting shaft 3221 may be fixed to the bottom of the plate 321 by screwing or soldering. The collar 3222 is mounted on the other end of the connecting shaft 3221, selectively abuts one of the arced guide tracks 12, and is movable along said one of the arced guide tracks 12.

Figure 7:
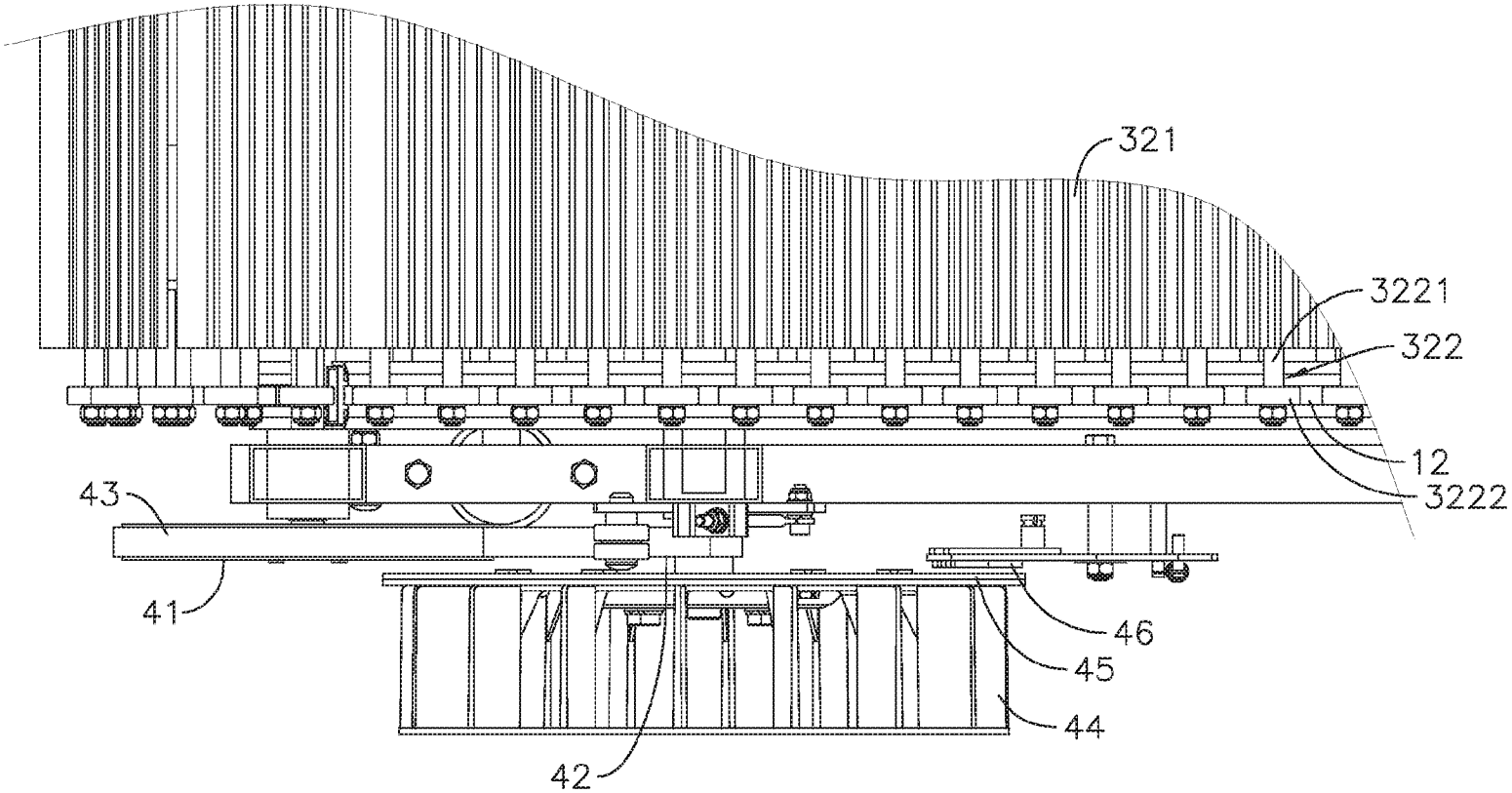
FIG. 7 is an enlarged partial top view of a flywheel assembly of the curved treadmill in FIG. 1.

With reference to FIGS. 1, 3 and 7, the two flywheel assemblies 40 are connected to the guide wheels 13 and located at the two sides of the support frame 11. Each flywheel assembly 40 has a large wheel 41, a small wheel 42, a transmission belt 43, a fan 44, a magnetic control disk 45, and a magnetic element 46.

The large wheel 41 is mounted on one of the two sides of the support frame 11, and is connected to and driven by one of the guide wheels 13. In this embodiment, the large wheel 41 is connected to the front end of the support frame 11 and is rotated synchronously with the guide wheel 13. The small wheel 42 is located at the same side of the support frame 11 on which the large wheel 41 is mounted, and the transmission belt 43 is mounted around the large wheel 41 and the small wheel 42 so that the small wheel 42 is driven by the large wheel 41 to rotate.

The fan 44 is connected to and driven by one of the guide wheels 13. Specifically, the fan 44 is fixed to the small wheel 42 to drive the guide wheels 13 at the front end of the support frame 11 to rotate via the transmission belt 43 and the large wheel 41. The fan 44 has multiple blades, and the blades extend radially. Therefore, wind generated by the fan 44 can be blown to the user to dissipate heat. Since the large wheel 41 is connected to the small wheel 42 by the transmission belt 43, the angular velocity of the small wheel 42 is greater than the angular velocity of the large wheel 41. The angular velocity of the fan 44 is equal to the angular velocity of the small wheel 42. The angular velocity of the guide wheels 13 at the front end of the support frame 11 is equal to the angular velocity of the large wheel 41. By the arrangement of different radiuses of the large wheels 41 and the small wheels 42, the angular velocity of the fan 44 is greater than the angular velocity of the guide wheels 13. Therefore, even if the user is running at a low speed, the fan 44 still has a sufficient angular velocity to generate sufficient air.

The magnetic control disk 45 is located between the fan 44 and the support frame 11. In this embodiment, the magnetic control disk 45 is fixed to the small wheel 42, and move together with the guide wheels 13 at the front side of the support frame 11. The magnetic control disk 45 is a metal disk. The magnetic element 46 is positionally adjustably mounted on one side of the support frame 11 and is adjacent to the magnetic control disk 45. With the above structure, when the magnetic control disk 45 is rotated by the guide wheels 13, electromagnetic induction is generated between the magnetic element 46 and the magnetic control disk 45, and the electromagnetic brake is exerted to allow the user to run on the curved treadmill subjected to resistance and to achieve the purpose of exercising. Alternatively, the magnetic control disk 45 may be directly fixed on the guide wheels 13 or the large wheels 14. The magnetic element 46 may be mounted on the corresponding position of the support frame 11.

In conclusion, the belt assembly 30 is mounted around the frame 10, and this makes the connection belts 31 mounted around the guide wheels 13 of the frame 10. The pedals 32 fixed on the connection belt 31 abut the arced guide tracks 12 via the bearings 322, and therefore the belt assembly 30 may encircle the arced guide tracks 12. Accordingly, the present invention is ergonomic by moving the belt assembly 30 along the arced guide tracks 12. The pedals 32 can be moved along the arced guide tracks 12 backward and downward along with the footsteps while the user is running, and easing the impact force at each step.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A curved treadmill comprising:
- a frame having
  - a support frame having a front end and a rear end;
  - two arced guide tracks respectively located on two sides of the support frame and being downwardly concave; and
  - multiple guide wheels disposed at the front end and the rear end of the support frame;
- a handrail assembly mounted on the two sides of the frame, and having a handrail; and
- a belt assembly mounted around the frame and having
  - at least one connection belt mounted around the guide wheels; and
  - multiple pedals fixed with the at least one connection belt, and the pedals being adjacent and connected to each other, and the pedals covered on an outer side face of each one of the at least one connection belt, and each pedal having
    - a plate fixed to the at least one connection belt; and
    - multiple bearings mounted on two ends of the plate and selectively abutting against the two arced guide tracks.

2. The curved treadmill as claimed in claim 1 further comprising
- two flywheel assemblies connected to the guide wheels and located at the two sides of the support frame, each flywheel assembly having
  - a magnetic control disk being a metal disk, the magnetic control disk connected to and driven by one of the guide wheels; and
  - a magnetic element positionally adjustable on one of the sides of the support frame and adjacent to the magnetic control disk.

3. The curved treadmill as claimed in claim 2, wherein each flywheel assembly has
- a large wheel mounted on one of the two sides of the support frame, the large wheel connected to and driven by one of the guide wheels; and
- a small wheel located at the same side of the support frame on which the large wheel is mounted, wherein the magnetic control disk is fixed to the small wheel; and
- a transmission belt mounted around the large wheel and the small wheel.

4. The curved treadmill as claimed in claim 1, wherein the curved treadmill further has a fan connected to one of the guide wheels.

5. The curved treadmill as claimed in claim 2, wherein each flywheel assembly further has a fan connected to one of the guide wheels, and the magnetic control disk is fixed to the fan.

6. The curved treadmill as claimed in claim 3, wherein each flywheel assembly further has a fan connected to one of the guide wheels, and the magnetic control disk is fixed to the fan.

7. The curved treadmill as claimed in claim 4, wherein the fan has multiple blades, and the blades extend in parallel in a radial direction of the fan.

8. The curved treadmill as claimed in claim 5, wherein the fan has multiple blades, and the blades extend in parallel in a radial direction of the fan.

9. The curved treadmill as claimed in claim 6, wherein the fan has multiple blades, and the blades extended in parallel in a radial direction of the fan.

10. The curved treadmill as claimed in claim 1, wherein each bearing has a connecting shaft and a collar, the connection shaft has two ends, one of the two ends of the connection shaft is fixed to the plate, and the collar is formed on the other end of the connection shaft.

11. The curved treadmill as claimed in claim 2, wherein each bearing has a connecting shaft and a collar, the connection shaft has two ends, one of the two ends of the connection shaft is fixed to the plate, and the collar is formed on the other end of the connection shaft.

12. The curved treadmill as claimed in claim 3, wherein each bearing has a connecting shaft and a collar, the connection shaft has two ends, one of the two ends of the connection shaft is fixed to the plate, and the collar is formed on the other end of the connection shaft.

13. The curved treadmill as claimed in claim 4, wherein each bearing has a connecting shaft and a collar, the connection shaft has two ends, one of the two ends of the connection shaft is fixed to the plate, and the collar is formed on the other end of the connection shaft.

14. The curved treadmill as claimed in claim 5, wherein each bearing has a connecting shaft and a collar, the connection shaft has two ends, one of the ends of the connection shaft is fixed to the plate, and the collar is formed on the other end of the connection shaft.

15. The curved treadmill as claimed in claim 6, wherein each bearing has a connecting shaft and a collar, the connection shaft has two ends, one of the two ends of the connection shaft is fixed to the plate, and the collar is formed on the other end of the connection shaft.

16. The curved treadmill as claimed in claim 7, wherein each bearing has a connecting shaft and a collar, the connection shaft has two ends, one of the two ends of the connection shaft is fixed to the plate, and the collar is formed on the other end of the connection shaft.

17. The curved treadmill as claimed in claim 8, wherein each bearing has a connecting shaft and a collar, the connection shaft has two ends, one of the two ends of the connection shaft is fixed to the plate, and the collar is formed on the other end of the connection shaft.

18. The curved treadmill as claimed in claim 9, wherein each bearing has a connecting shaft and a collar, the connection shaft has two ends, one of the two ends of the connection shaft is fixed to the plate, and the collar is formed on the other end of the connection shaft.

* * * * *